US008893616B2

(12) United States Patent
Liu

(10) Patent No.: US 8,893,616 B2
(45) Date of Patent: Nov. 25, 2014

(54) GHOST-FREE INKING METHODS, APPARATUS, AND SYSTEMS WITH REDUCED FOUNTAIN SOLUTION CONTAMINATION

(75) Inventor: Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 388 days.

(21) Appl. No.: 13/192,137

(22) Filed: Jul. 27, 2011

(65) Prior Publication Data

US 2013/0025487 A1 Jan. 31, 2013

(51) Int. Cl.
*B41F 35/00* (2006.01)
*B41F 31/00* (2006.01)

(52) U.S. Cl.
CPC ..... *B41F 31/00* (2013.01)
USPC ..... 101/425; 101/487

(58) Field of Classification Search
USPC ..... 101/425
See application file for complete search history.

(56) References Cited

U.S. PATENT DOCUMENTS

| | | | | | |
|---|---|---|---|---|---|
| 4,407,196 | A * | 10/1983 | Matalia et al. | ..... | 101/142 |
| 4,625,643 | A * | 12/1986 | Davis | ..... | 101/363 |
| 4,864,925 | A * | 9/1989 | Van Kanegan et al. | ..... | 101/141 |
| 5,044,274 | A * | 9/1991 | Gaunt | ..... | 101/142 |
| 5,205,216 | A * | 4/1993 | Okamura et al. | ..... | 101/367 |
| 5,628,914 | A * | 5/1997 | Prasil | ..... | 210/770 |
| 6,418,844 | B1 * | 7/2002 | Franklin et al. | ..... | 101/147 |
| 6,546,869 | B1 * | 4/2003 | Eltner et al. | ..... | 101/483 |
| 6,547,970 | B1 * | 4/2003 | Shinoda | ..... | 210/710 |
| 6,951,174 | B2 * | 10/2005 | Price et al. | ..... | 101/483 |
| 7,801,465 | B2 * | 9/2010 | Thompson et al. | ..... | 399/250 |
| 8,141,487 | B2 * | 3/2012 | Lefken et al. | ..... | 101/423 |
| 2002/0038611 | A1 * | 4/2002 | Naniwa et al. | ..... | 101/465 |
| 2012/0103212 | A1 | 5/2012 | Stowe et al. | | |

* cited by examiner

*Primary Examiner* — Anthony Nguyen
(74) *Attorney, Agent, or Firm* — Ronald E. Prass, Jr.; Prass LLP

(57) ABSTRACT

A digital offset inking system includes an ink supply, a soft transfer roll, and a hard form roll. A cleaning blade cleaning ink and fountain solution from the surface of the hard form roll that is leftover after transferring ink to a digital imaging member. A fountain solution removal system processes the ink to remove the fountain solution from the ink. The processes ink is resupplied to the inking system for transfer to the digital imaging member.

15 Claims, 3 Drawing Sheets

GHOST-FREE INKING METHODS, APPARATUS, AND SYSTEMS WITH REDUCED FOUNTAIN SOLUTION CONTAMINATION

FIELD OF DISCLOSURE

The disclosure relates to digital offset printing. In particular, the disclosure relates to inking methods and systems for use in digital lithographic offset printing systems.

BACKGROUND

In related art digital offset lithographic printing systems, a dampening system applies a thin layer of fountain solution onto a surface of a digital offset plate. An imaging system then evaporates the fountain solution film in an image area using a high power laser. A latent image is formed on the surface of the digital offset plate. The latent image corresponds to a pattern of the applied fountain solution that is left over after evaporation.

An inking system may be used to apply a uniform layer of ink over a surface layer of an imaging plate. Typically, ink is depleted from an inker form roll as the ink is transferred onto the imaging plate. As a portion of the imaging plate containing the latent image passes through the inking system, the ink adheres or develops onto the image area where the fountain solution has been removed by evaporation.

Ink from the form roll may split onto the imaging drum during ink transfer, leaving behind some ink on the form roll. During metering of ink onto the form roll, not all areas on the form roll are covered with the same thickness of ink. Ghosting can result if an ink layer is uneven and has areas of thinly-layered ink that cause corresponding lighter areas in image prints. Further, ghosting can result from the negative image left on the form roll after ink transfer to the digital imaging plate. The negative ink thickness pattern builds up after subsequent ink transfers from the form roll to the imaging plate.

After ink transfer from the form roll to the imaging plate, the ink image may be subject to pre-cure treatment to optimize its cohesion or ink tack for transfer of the image to a substrate. After transfer to the substrate, a final curing process is applied to fix the image to the substrate. The transferring portion of the digital imaging plate then proceeds to a cleaning station, and subsequently returns to the dampening station for application of fountain solution.

Fountain solution prevents ink from adhering to the imaging plate during transfer of the ink to the plate. At an exit of the ink transfer nip defined by the imaging plate and the ink form roll, the fountain solution film may split. About one half of the fountain solution film may remain on the plate, and the other about half may be transferred to the form roll, on top of the ink layer.

In traditional inking systems, fountain solution may mix with ink, and the mixture will travel along an inking member train, being mixed, beaten, and split between rollers of the ink train. Accordingly, the ink and fountain solution mixture becomes emulsified. In traditional systems, the emulsification does not present an immediate problem because the traditional offset printing plate includes an image area that is fountain solution repelling. The fountain solution repelling characteristic of the imaging area allows the inking system to have a significant amount of fountain solution in the ink and still produce an acceptable print.

In digital offset, there is no distinction between image and non-image areas of an imaging plate. The plate may be configured to strongly attract fountain solution so that the solution completely wets the plate in order to maintain an acceptable fountain solution film and reject ink.

SUMMARY

Inking systems that accommodate ghostless digital offset printing are disclosed. Inking methods, apparatus, and systems are provided that clean ink and fountain solution from a form roll of an inking system, and process the ink and fountain solution mixture, and resupply cleaned and processed ink that is substantially free of fountain solution to the inking system for transfer to a digital imaging member such as a plate or drum.

In an embodiment, digital offset inking methods may include metering a uniform layer of ink onto a hard form roll from a transfer roll of an inking system, the transfer roll having a conformable surface; and transferring the ink of the uniform layer directly from the hard form roll to a digital imaging member; cleaning ink and fountain solution from the hard form roll; and separating the ink from the fountain solution.

In an embodiment, methods may include removing ink from a surface of the form roll, the ink being leftover from the transferring the ink to the digital imaging member. Methods may include removing the fountain solution from the surface of the form roll, the fountain solution being transferred to the form roll during the transferring the ink to the digital imaging member. In an embodiment, the removing ink may include contacting the hard surface of the form roll with a cleaning blade whereby ink is removed from the form roll. In an embodiment, contacting a surface of the form roll with the cleaning blade, whereby the fountain solution is removed from the form roll.

In an embodiment, methods may include collecting the removed ink and the removed fountain solution, the ink and the fountain solution being a mixture contained in a fountain solution removal system. Methods may include separating fountain solution from ink by evaporating the fountain solution from an ink and fountain solution mixture to yield ink that is substantially free of the fountain solution.

In an embodiment, methods may include evaporating the fountain solution by heating the ink and fountain solution mixture to evaporate the fountain solution from the mixture. In an embodiment, the evaporating may include heating the ink and the fountain solution mixture using conductive or convective heat transfer to evaporate the fountain solution from the mixture. In another embodiment, methods may include separating the fountain solution from the ink using a phase separation process.

In an embodiment, methods may include receiving the ink substantially free of fountain solution at an ink supply, the ink supply being configured to supply ink to the inking system. In an embodiment, methods may include supplying the received ink to the inking system, the received ink being substantially free of fountain solution.

In an embodiment, apparatus may include a form member; a cleaning member, the cleaning member being configured to contact the form member for removing ink and fountain solution from a surface of the form member; and a fountain solution removal system, the fountain solution removal system comprising a reservoir, the reservoir being configured to contain an ink and fountain solution mixture, the mixture comprising the ink and the fountain solution removed from the surface of the form member by the cleaning member, the fountain solution removal system being configured to separate the fountain solution from the ink of the ink and fountain solution mixture.

The form member may be a rotatable roll. For example, the form member may be a drum having a surface comprising anodized aluminum, stainless steel, other metals, or ceramic materials. The cleaning member may be blade. The cleaning member may be hard, and capable of exerting a high pressure against the form roll, which may have a hard smooth surface. Depending on a viscosity of ink used in the inking system, the cleaning member may comprise hard rubber, polyurethane, plastics, steel, or metal.

In an embodiment, apparatus may include an anilox member, the anilox member being configured to receive ink form an ink supply; a doctor blade, the doctor blade being configured to remove excess ink supplied to the anilox member; a soft metering member; and a smoothing member. In an embodiment, apparatus may include the anilox member, the soft metering member, the smoothing member, and the hard form member being rolls, the roll being rotatable about a central longitudinal axis, and the smoothing roll being movable axially whereby the smoothing roll spreads ink on a surface of the form roll. In an embodiment, the smoothing roll being movable axially is configured to smooth the ink layer on a surface of the soft metering member.

Apparatus may include one or more smoothing members or rolls. At least one of the smoothing member, a transfer member, and a form member may be rolls. At least one of the smoothing roll, the transfer roll, and the form roll may be rotatable about a central longitudinal axis. In an embodiment, the one or more rolls may be configured to move in one or more directions axially to enhance ink smoothing and application of a uniform layer of ink onto a surface of the transfer member or the form roll for transfer to a digital imaging member.

In an embodiment, apparatus may include the fountain solution removal system further comprising a heat source for heating the fountain solution and ink removal system to evaporate the fountain solution from the ink of the ink and fountain solution mixture. In an embodiment, apparatus may include a heat source that heats the ink and fountain solution mixture using convection heating. In alternative embodiment, the fountain solution removal system may be connected to an ink supply, wherein the ink supply receives ink from the fountain solution removal system, the received ink being substantially free of fountain solution.

In an embodiment, digital offset inking systems may include an inking system for transferring a uniform layer of ink to a digital imaging member, the inking system having a soft transfer member, a hard form member, and a cleaning blade for contacting a surface of the form member to remove ink and fountain solution from a surface thereof. Systems may include a fountain solution removal system for receiving the ink and fountain solution removed from the surface of the hard form member, the received ink and fountain solution being a mixture, and processing the ink to separate the fountain solution from the ink of the ink and fountain solution mixture.

In an embodiment, apparatus may include a heating system for heating the ink and fountain solution mixture to evaporate fountain solution from the ink and fountain solution mixture whereby the ink is substantially free of fountain solution. In an alternative embodiment, the apparatus may include a phase separation system for phase separation of the ink and fountain solution to separate fountain solution from ink removed from a form member after an ink transfer process to a digital imaging member. In an embodiment of apparatus, an ink supply system for supplying ink to the inking system, the ink comprising ink that is processes by the fountain solution removal system.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
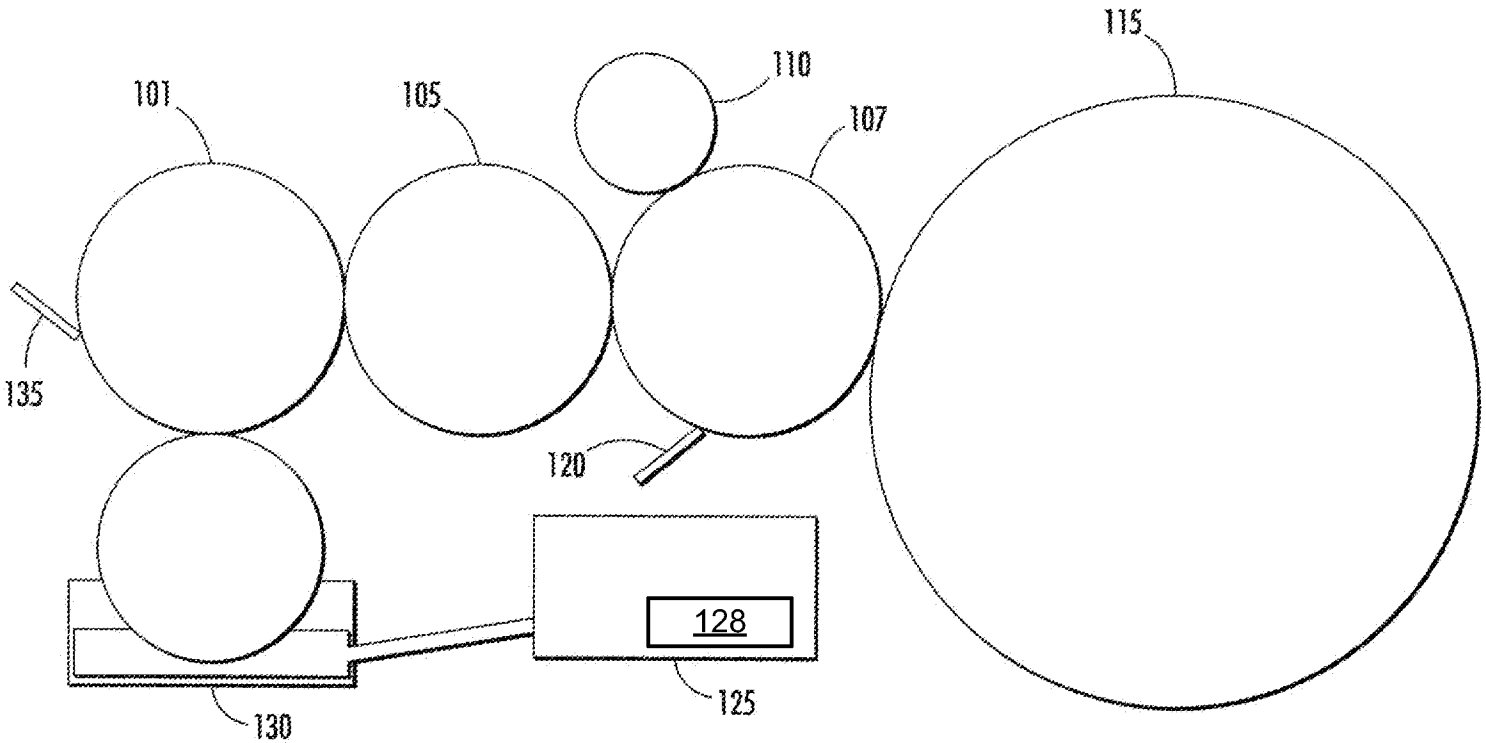
FIG. 1 shows a digital offset inking system with a fountain solution removal system in accordance with an exemplary embodiment.

Exemplary embodiments are intended to cover all alternatives, modifications, and equivalents as may be included within the spirit and scope of the apparatus and systems as described herein.

Reference is made to the drawings to accommodate understanding of methods, apparatus, and systems for inking to a digital offset plate for ghostless digital offset ink printing. In the drawings, like reference numerals are used throughout to designate similar or identical elements. The drawings depict various embodiments and data related to embodiments of illustrative methods, apparatus, and systems for inking from an inking member to an imaging member for ghostless printing, and recycling ink cleaned from a surface of a form member of the inking system.

Inking systems or inker subsystems in accordance with embodiments may be incorporated into a digital offset architecture so that the inking system is arranged about a central imaging plate. The imaging plate may be a cylinder or drum. A surface of the imaging member is reimageable, and conformable. The conformable surface may comprise, for example, silicone. A paper path architecture may be situated about the imaging member to form a media transfer nip.

A uniform application of fountain solution may be applied to a surface of the central imaging cylinder by a dampening system. In a digital evaporation step, particular portions of the fountain solution layer applied to the surface of the central imaging cylinder may be evaporated by a digital evaporation system. For example, portions of the fountain solution layer may be evaporated by laser patterning.

In an inking step, ink may be transferred from an inking system to the surface of the central imaging cylinder. The transferred ink adheres to portions of the surface of the central imaging cylinder where fountain solution has been evaporated. In a partial cure step, the transferred ink may be partially cured by irradiation. For example, UV cure source(s) may be arranged about the imaging member. In an image transfer step, the transferred ink may be transferred to media such as paper at a media transfer nip.

A surface of the central imaging cylinder may be cleaned by a cleaning system. For example, trace cleaning rollers may be used to clean the surface of the central imaging member. In a digital offset printing process, previously imaged ink must be removed from the imaging member to prevent ghosting. New ink applied to the imaging plate or other imaging member from an inking system should have no history of thickness depletion due to prior ink transfer.

The inking system may include an inking member such as an anilox roll. The anilox roll may have wells or cells in a surface thereof for carrying ink to the imaging member. The wells may be mechanically or laser engraved, and may be configured to contain a volume of ink. The anilox roll may be configured in an inking system so that a surface of the roll is submerged in an ink chamber or ink sump. An anilox doctor blade may be arranged to contact a surface of the anilox roll for leveling ink supplied to the roll by the ink sump as the anilox roll rotates in a process direction.

The inking system may include an intermediate soft transfer roll. The transfer roll may have a soft, conformable surface made of, for example, rubber. Alternatively, the surface of the transfer roll may comprise foam. The transfer roll may be configured to define a first ink transfer nip with the anilox roll. The transfer roll is rotatable in a direction opposing a direction of rotation of the anilox roll. Ink may be metered onto the transfer roll at the first ink transfer nip. The transfer roll may be urged against the anilox roll to squeeze the ink at the first ink transfer nip to pick up the ink as the ink is metered onto the transfer roll.

Alternatively, the inking system may include a traditional roller-type inking unit configured for intermittent ink feeding, an oscillating vibrator roll, one or more ink splitting, ink transfer and ink smoothing rolls, and an intermediate soft transfer roll. The intermediate soft transfer roll may be arranged at a front of a chain of such rolls to carry a uniform layer of ink of a desired thickness.

An ink form member such as a roll having a hard surface may be arranged to define a second transfer nip with the soft intermediate transfer roll. The ink form roll may be a cylindrical drum or other suitable member. The ink form roll may comprise a hard surface. For example, the ink form member may be a roll having a surface comprising metal. The ink member may be an aluminum drum. Alternatively, the ink form member may include a surface comprising stainless steel, other metals, or ceramic(s).

The hard surface of the form member enables use of a cleaning blade for cleaning ink from the form member. For example, a doctor blade may be applied to the surface of the form roll to wipe or scrape ink from the form member that is leftover after transferring ink to an imaging member. Ghostless variable data printing with offset ink requires that an inker subsystem form roll have substantially no prior ink history from a prior process of transferring ink onto an imaging plate. Because the surface of the form member is hard, the doctor blade can be applied without degrading the form member surface.

The form member may be configured to contact an imaging plate and transfer ink onto a reimageable surface thereof. For example, the form member may be a roll, and the digital imaging member may be a roll. The form roll and the imaging roll may define a third ink transfer nip. The rolls may rotate in opposing directions for metering a uniform layer of ink onto a surface of the imaging roll. The imaging member has a soft, conformable surface. For example, the imaging member may include a surface comprising silicone such as a silicone imaging blanket, or the imaging member may be configured as described by Stowe et al. in "Variable Data Lithography System" (U.S. patent application Ser. No. 13/095,714), as appropriate.

Smoothing members such as one or more smoothing rolls may be arranged about the form member. The smoothing rolls may be configured to spread the ink on the surface of the form member by contacting the ink. At least one of the transfer member, the form member, and the one or more smoothing rolls, for example, may be configured to rotate about a longitudinal axis, and may be configured to be movable axially. For example, the smoothing rolls may be configured to move back and forth axially while rotating for enhanced spreading and smoothing of the ink on the form member before transfer of the ink to the digital imaging member. Alternatively, the smoothing roll being movable axially is configured to smooth the ink layer on a surface of the soft metering member. A smoothing may be configured, for example, to perform a smoothing function on ink on a surface of a soft intermediate transfer member such as a roll. For example, the smoothing member may be configured to remove an anilox roll pattern from an ink layer metered onto a surface of a transfer member.

A surface of the imaging member may be wear resistant and flexible. The surface of the imaging member may have an elasticity and durometer, and sufficient flexibility for coating ink over a variety of different media types having different levels of roughness. A thickness of the reimageable surface layer may be, for example, about 0.5 micrometers to about 4 millimeters. A surface of the imaging member should have a weak adhesion force to the ink at the interface, yet good oleophilic wetting properties with the ink for promoting uniform inking of the reimageable surface and subsequent transfer lift off of the ink onto the substrate.

Accordingly, the soft, conformable surface of the imaging member may comprise silicone. Other materials may be employed, including blends of polyurethanes, fluorocarbons, etc. The surface may be configured to conform to a substrate on which the ink image is printed. To provide effective wetting of dampening solutions such as water-based fountain solution, the silicone surface need not be hydrophilic, but may be hydrophobic. Wetting surfactants, such as silicone glycol copolymers, may be added to the dampening solution to allow the dampening solution to wet the silicone surface. The imaging member may be a roll or drum, or may be a flat plate, surface of a belt, or other structure.

A fountain solution removal system in accordance with embodiments may include a removed ink reservoir. The removed ink reservoir may receive ink and fountain solution that is leftover on the form member after ink is transferred from the form member to the imaging member. Specifically, as a result of transferring ink onto the surface of the imaging member from the form member, ink may split and remain on the form member. The leftover ink may contribute to ghosting and formation of an uneven ink layer on a surface of the form member.

Fountain solution that is added to the imaging member to form a layer thereon that prevents ink from adhering to the imaging member. At an exit of the third transfer nip defined by the form member and the imaging member, the fountain solution layer or film may split, and a portion of the film may be transferred to the form member. For example, about one half of the film may remain on the imaging member, and the other one half may be transferred to the form member. Ink that is removed from the form member should not contain an amount of fountain solution that causes voids in the transferred ink layer. Specifically, if ink that is removed from the cleaning roll contains fountain solution is re-supplied to the inking system with the fountain solution contained therein, the fountain solution may emulsify, may be attracted to the imaging plate during ink transfer, and may cause formation of voids in an ink layer on the imaging member.

The fountain solution removal system may be located adjacent to a form member so that ink cleaned from the form member may be captured at the removed ink reservoir. For example, the cleaning member may scrape or wipe ink and fountain solution from a surface of the form member after the transfer of ink from the form member to the imaging member. The cleaning member may remove a mixture of ink and fountain solution from the surface of the form member as a result of ink being leftover on the form member and fountain solution being transferred to the form member during the transferring ink from the form member to the imaging member.

The fountain solution removal system may be configured to receive the ink and/or ink and fountain solution mixture cleaned from the form member. The fountain solution removal system may be connected to a heat source, and may apply heat to the ink and fountain solution mixture to evaporate fountain solution from the mixture. For example, the fountain solution may be evaporated by conduction or convection heating. Alternatively, the fountain solution removal system may include a phase separation system for separating the fountain solution and the ink using phase separation techniques. The ink and fountain solution can be chosen to be incompatible/immiscible such that it is energetically favorable for the ink and fountain solution to naturally separate into two distinct phases. The two distinct material phases can then be separated by means that take advantage of their physical property differences such as weight difference or viscosity difference.

An ink supply system may communicate with the fountain solution removal system having the removed and processed ink. A portion of the anilox member may be submerged in ink at the ink supply. Alternatively, an ink donor member may interpose the ink supply and the anilox member. For example, the anilox member may be an anilox roll that rotates through the ink contained in the ink sump whereby the ink sump supplies ink to a surface of the anilox roll. The ink may be contained in the cells of the anilox roll, and excess ink on a surface of the roll may be cleaned using an anilox doctor blade. The anilox doctor blade may be configured to doctor excess ink deposited in a cell of the anilox member from the surface of the anilox member.

The cleaning member may be a form member doctor blade that is configured to contact a surface of the form member. The form member doctor blade may be formed of a material comprising metal, hard plastic, or polyurethane. The form member doctor blade may be formed of a hard material that is suitable for scraping ink from a surface of the hard form member. The form member doctor blade surface may be oleophobic, and may comprise, for example a coating of TEFLON.

The fountain solution removal system processes ink so that ink removed from the surface of the form member may be substantially free of fountain solution, and therefore can be resupplied to the inking system without degrading print quality or causing voids in an ink layer on the surface of the imaging member. The ink that is free of fountain solution may include a negligible amount of fountain solution that is present in an amount that is low enough to be acceptable for resupply of the ink to the anilox member without degrading ink transfer or ink printing. As such, in an embodiment wherein the removed ink may be added to an ink supply for resupply to an anilox member, the ink supply may remain substantially free of fountain solution. Accordingly, ink removed from the form member by cleaning the form member with the doctor blade, and processed by the fountain solution removal system to remove fountain solution, may be recycled for resupply to the inking system.

FIG. 1 shows an apparatus and system for digital offset inking, form member cleaning, and fountain solution removal in accordance with an embodiment. Specifically, FIG. 1 shows an inking apparatus having an anilox roll 101, an intermediate transfer roll 105, and a form roll 107. Apparatus may include one or more smoothing rolls 110. Smoothing roll 110 may be rotatable about a central longitudinal axis, and may be movable in an axial direction. For example, the smoothing roll 110 may move back and forth axially to enhance smoothing and spreading of the ink on the form member 107. Alternatively, the smoothing roll 110 may be arranged to contact the intermediate transfer roll 105 to perform the ink smoothing function on it. FIG. 1 shows the inking apparatus arranged with a digital imaging roll 115. The digital imaging member has a conformable surface. For example, a surface of the imaging member may comprise silicone. While FIG. 1 shows components that are formed as rolls, other suitable forms and shapes may be implemented.

The anilox roll 101 is a cylindrical rotatable roll having cells or wells defined in a surface thereof. The cells may be mechanically or laser engraved. The anilox roll 101 may be submerged in supply ink, and may be rotated through the ink for uptaking ink into the cells. Alternatively, an ink donor roll may interpose the anilox roll and the ink of the ink supply. The anilox roll may be heated, and may be temperature controlled. Depending on properties of the ink being used, such as a viscosity of the ink, a temperature of the anilox member may be adjusted improved smoothing and spreading of the ink at one or more ink transfer nips of the inking system.

The intermediate transfer roll 105 may define a first ink transfer nip with the anilox roll 101. Ink carried by the anilox roll 101 may be carried to the first ink transfer nip, and metered onto the transfer roll 105 in a uniform layer. The transfer roll 105 may be rotatable in a direction opposing a direction of rotation of the anilox roll 101. The intermediate roll 105 may have a diameter that is greater than or less than a diameter of the anilox roll 101.

The intermediate transfer roll 105 may have a soft surface. For example, the surface may comprise rubber, polyurethane, closed form or other suitable material. The intermediate transfer roll 105 may be a rotatable drum, or other member suitable for defining an ink transfer nip with an anilox roll 101 and a hard form roll such as form roll 107. The soft intermediate transfer roll 105 may define a second transfer nip with the hard form roll 107. The intermediate transfer roll 105 may transfer ink from the anilox roll 101 to the hard form roll 107 in a uniform layer.

As shown in FIG. 1, the form roll 107 may define a third ink transfer nip with a digital imaging member 115. The digital imaging member may be a roll as shown in FIG. 1. Alternatively, the digital imaging member may be a plate. A surface of the imaging roll 115 is soft, conformable, and reimageable. For example, the surface may comprise a silicone surface. An imaging member may comprise, for example, a silicone imaging blanket. The surface of the imaging roll 115 may be wear resistant and flexible. The digital imaging roll 105 may rotate in a direction that opposes a direction of rotation of the form roll 107. At the third transfer nip, ink may be metered form the hard form roll 108 to the digital imaging roll 115 in a uniform layer.

As the hard form roll 107 contacts the digital imaging roll 115 at the third transfer nip to squeeze ink therebetween and transfer the ink onto the soft imaging member 115 surface, some ink may be left behind on the hard form roll 107. Further, as the hard form roll 107 contacts the digital imaging roll 115 at the third ink transfer nip to squeeze ink therebetween, fountain solution that may be deposited on a surface of the digital imaging member 115 prior to ink transfer may migrate from the digital imaging roll 115 to the hard form roll 107. Accordingly, the fountain solution may be mixed with leftover ink on a surface of the form roll 107 that leaves a third transfer nip after ink transfer to the digital imaging roll 115.

A form member cleaning member such as a cleaning blade 120 is show in FIG. 1. The cleaning blade 120 may be configured to contact, scrape, and or wipe ink and/or a mixture of ink and fountain solution from a surface of the form member 107. The cleaning blade 120 may be positioned to contact a portion of the form member 107 substantially immediately after the portion passes through the third ink transfer nip defined by the digital imaging member 115 and the form member 107.

As shown in FIG. 1, a fountain solution removal system 125 may be positioned below the inking apparatus. The fountain solution removal system 125 may include a reservoir for containing ink removed by the cleaning blade 120. Because the form roll 107 has a hard surface, the form roll doctor blade 120 may be configured to contact a surface of the form roll 107 for removing leftover ink and fountain solution from a surface of the form roll 107. The cleaning blade 120 may comprise a metal material, hard plastic, hard rubber, or other material suitable for removing ink from the hard surface of the form roll 107.

Ink and fountain solution removed from the form member 107 by the cleaning member 120 may be received by the fountain solution removal system 125. The fountain solution removal system 125 may be configured to separate the fountain solution from the ink. For example, in one embodiment, the ink and fountain solution mixture may be heated by a heat source or heating system 128 to evaporate the fountain solution from the ink. The mixture may be heated by conduction or convection. In an alternative embodiment, the fountain solution may be separated from the ink using phase separation techniques.

After the fountain solution is separated from the ink by the fountain solution removal system 125, the ink of the ink reservoir may flow or be caused to migrate to an ink supply 130 for mixing with supply ink. The supply ink may contain the recycled ink that is substantially free of fountain solution. The supply ink containing the recycled ink may be supplied to the anilox roll 101. As ink is supplied to the anilox roll 101, an anilox doctor blade 135 may be configured to contact a surface of the anilox member 101 to level ink contained in the cells of the anilox member 101.

Figure 2:
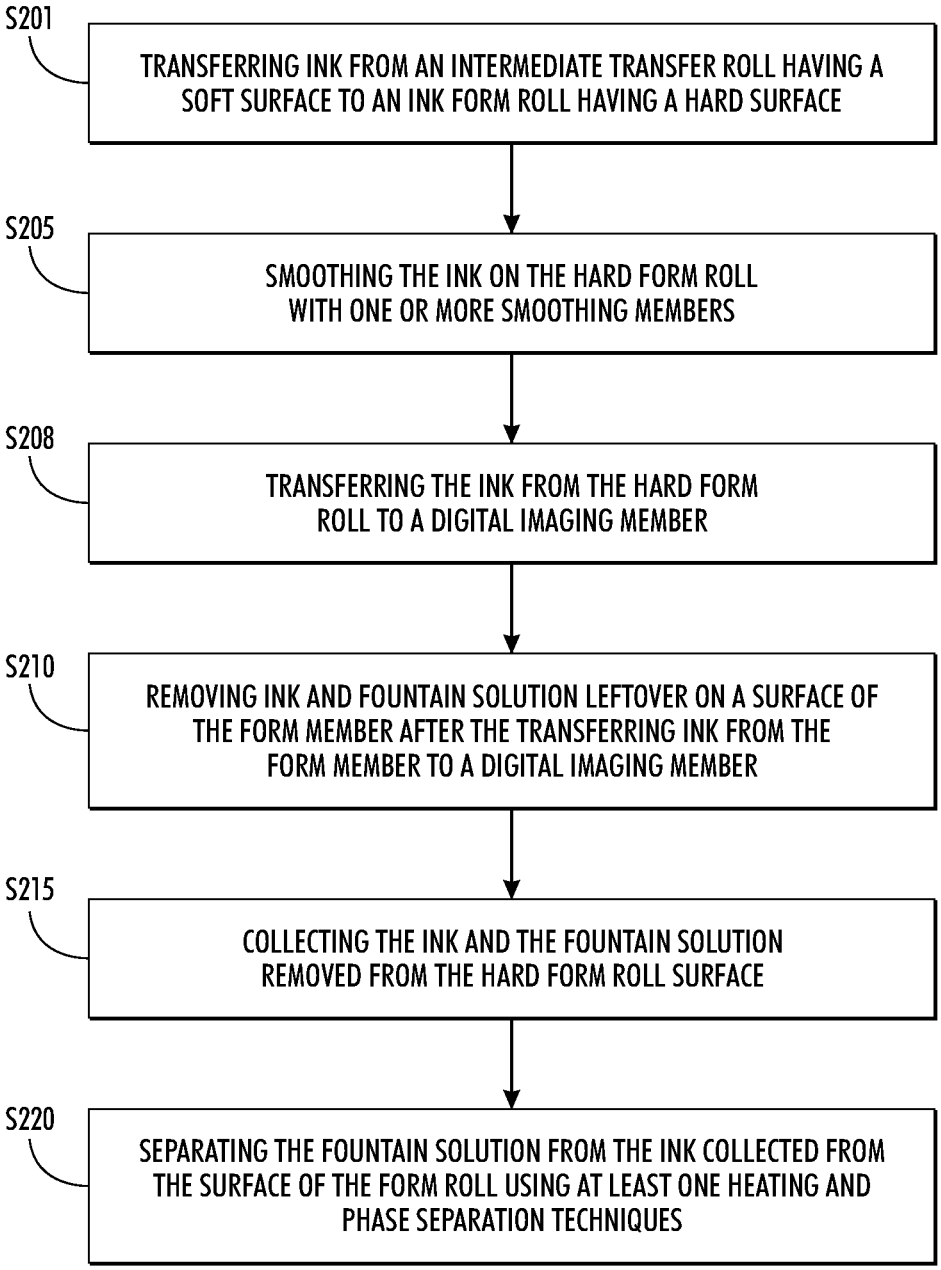
FIG. 2 shows digital offset inking methods in accordance with an exemplary embodiment.

FIG. 2 shows methods for digital offset inking in accordance with an embodiment. Specifically, methods may include transferring ink from an intermediate transfer roll having a soft surface to an ink form roll having a hard surface at S201. By using a hard form roll for transfer of ink to a surface of a digital imaging member, a cleaning blade or similar structure may be used to contact a surface of the hard form roll for cleaning. For example, the cleaning blade may be configured to remove ink and fountain solution leftover form an ink transfer process, the ink and/or mixture of ink and fountain solution being removed from a surface of the roll by scraping, and/or wiping. For example, the doctor blade may be arranged to be substantially stationary, and form roll may be rotatable. As the form roll rotates, the doctor blade may remove ink and fountain solution that is leftover from the transfer process from the surface of the form roll.

At S205 the ink that has been metered onto the hard form roll may be smoothed on the hard form roll with one or more smoothing members. At S208, the ink on the form roll may be transferred to a digital imaging member, which may be a plate or drum having a conformable surface. As a result of S208, ink may split and be left on the form member, and fountain solution applied to the imaging member may transfer to the form member.

At S210, the leftover ink and fountain solution may be removed from the surface of the form member after the transferring ink from the form member to a digital imaging member. Preferably, the removing ink and fountain solution at S210 may occur substantially immediately after S208. In an embodiment, the removing the ink and fountain solution at S210 may occur before the portion of the surface of the form member from which ink and fountain solution is removed receives ink from an intermediate transfer member.

At S215, the removed ink and fountain solution may be collected. For example, an ink reservoir contained by or associated with a fountain solution removal system may be configured to receive the ink and fountain solution removed by a cleaning member from the surface of the form member. At S220, the collected ink and fountain solution mixture may be processed to separate the fountain solution from the ink collected from the surface of the form roll. For example, the fountain solution may be separated from the ink by heating the mixture using conduction or convection heating. In an alternative embodiment, the fountain solution may be removed from the ink using phase separation techniques.

Figure 3:
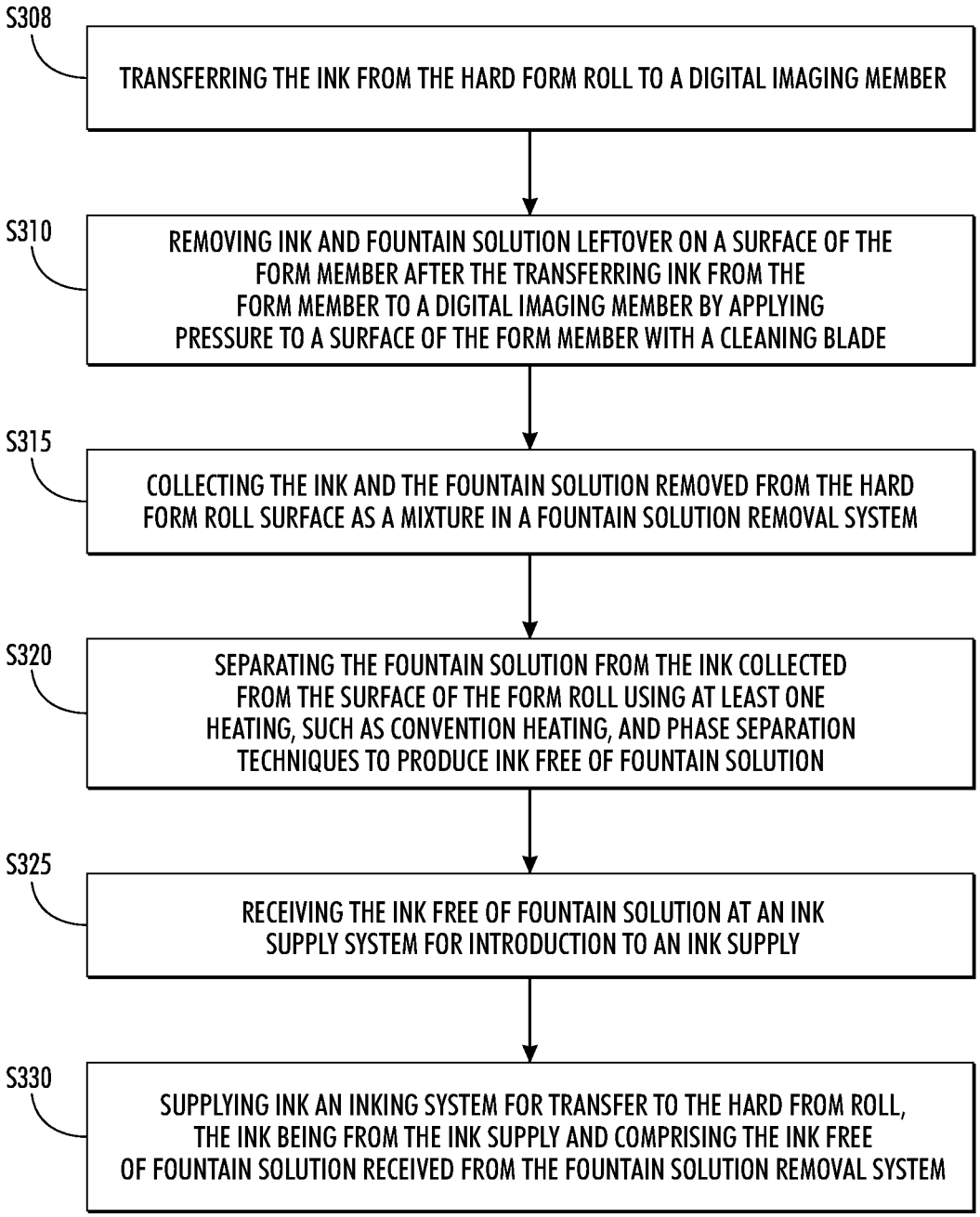
FIG. 3 shows form roll cleaning and ink recycling methods in accordance with an exemplary embodiment.

FIG. 3 shows form roll cleaning and ink recycling methods in accordance with an exemplary embodiment. Methods may include transferring the ink from a hard form roll to a digital imaging member at S308. At S310, ink and fountain solution leftover on a surface of the form roll after the transferring ink from the form roll to the digital imaging member may be removed by applying pressure to a surface of the form roll with a cleaning member such as a cleaning blade.

The ink and fountain solution removed from a surface of the form roll may be collected at S315. The ink and fountain solution may be collected as a mixture in the fountain solution removal system.

The fountain solution removal system may process the ink by separating the fountain solution from the ink collected from the surface of the form roll at S320. The fountain solution may be separated from the ink by heating the mixture to evaporate the fountain solution. For example, the mixture may be heated by conduction to evaporate the fountain solution. Alternatively, the mixture may be heated by convection to evaporate the fountain solution. In another alternative embodiment, the fountain solution may be separated from the ink of the mixture by using phase separation techniques.

At S325, the ink free of fountain solution may be received at an ink supply system. The ink supply system may be configured to supply ink to the inking system. The ink of the ink supply may include the ink collected from the form roll, and processed by the fountain solution removal system.

At S330, ink from the ink supply may be supplied to the inking system for transfer to the hard from roll. The ink from the ink supply may comprise ink that was removed from the form roll, and processed by the fountain solution removal system. Accordingly, ink may be recycled from the form roll for resupply to the inking system without realizing ghosting issues and other image artifacts, or creating voids in an ink layer on a surface of the imaging member. The process may be repeated as needed for a print job. For example, if further inking is to be performed, then the process may return to S308 after carrying out S330.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A digital offset inking method, comprising:

metering a uniform layer of ink onto a hard form roll from a transfer roll of an inking system, the transfer roll having a conformable surface; and transferring the ink of the uniform layer directly from the hard form roll to a digital imaging member;

cleaning a combination solution that includes ink and fountain solution from the hard form roll, the cleaning including removing the combination solution from the surface of the hard form roll, the fountain solution being transferred to the hard form roll during the transferring the ink to the digital imaging member;

collecting the removed combination solution to a reservoir of a fountain solution removal system; and separating the ink from the fountain solution by subjecting the combination solution to a separation procedure while the combination solution is in the reservoir, wherein the cleaning step further comprises contacting a hard surface of the hard form roll with a cleaning blade whereby the combination solution is removed from the hard form roll, and the separating procedure includes evaporating the fountain solution from the combination solution to yield ink that is substantially free of the fountain solution.

2. The method of claim 1, wherein the evaporating includes heating the combination solution to evaporate the fountain solution from the mixture.

3. The method of claim 1, wherein the evaporating includes heating the combination solution using convective heat transfer to evaporate the fountain solution from the mixture.

4. The method of claim 1, further comprising:

receiving the ink substantially free of fountain solution at an ink supply, the ink supply being configured to supply ink to the inking system.

5. The method of claim 4, comprising:

supplying the received ink to the inking system, the received ink being substantially free of fountain solution.

6. A keyless digital offset inking apparatus, comprising:

a hard form member;

a cleaning member, the cleaning member being a cleaning blade that contacts the hard form member for removing a combination solution that includes ink and fountain solution from a surface of the hard form member; and a fountain solution removal system, the fountain solution removal system comprising a reservoir, the reservoir being configured to contain combination solution, the combination solution comprising the ink and the fountain solution removed from the surface of the hard form member by the cleaning member, the fountain solution removal system being configured to separate the fountain solution from the ink by subjecting the combination solution to a separation procedure while the combination solution is in the reservoir, wherein the fountain solution removal system includes a heat source for heating the combination solution during the separation procedure to evaporate the fountain solution from the ink of the combination solution.

7. The apparatus of claim 6, further comprising:

an anilox member, the anilox member being configured to receive ink from an ink supply;

a doctor blade, the doctor blade being configured to remove excess ink supplied to the anilox member;

a soft metering member; and a smoothing member.

8. The apparatus of claim 7, wherein the anilox member, the soft metering member, the smoothing member, and the hard form member being rolls, the hard form member being rotatable about a central longitudinal axis, and the smoothing roll being movable axially whereby the smoothing roll spreads ink on a surface of the hard form member.

9. The apparatus of claim 6, wherein the heat source heats the combination solution using convection heating.

10. The apparatus of claim 6, wherein the fountain solution removal system is connected to an ink supply, and the ink supply receives ink from the fountain solution removal system, the received ink being substantially free of fountain solution.

11. The apparatus of claim 6, comprising:

an intermittent inking system, the intermittent inking system including a vibrating oscillating roll, a smoothing roll, and an intermediate transfer roll, the intermediate transfer roll having a soft surface, and the intermediate transfer roll being configured to meter a uniform layer of ink onto the hard form member.

12. The apparatus of claim 7, wherein the smoothing member is configured to contact the metering member for smoothing ink on the metering member.

13. A digital offset inking system, comprising:

an inking system for transferring a uniform layer of ink to a digital imaging member, the inking system having an soft transfer member, a hard form member, and a cleaning blade for contacting a surface of the hard form member to remove a combination solution that includes ink and fountain solution from a surface of the hard form member;

a fountain solution removal system for receiving the combination solution removed from the surface of the hard form member, the fountain solution removal system including a reservoir, the reservoir being configured to contain the combination solution removed from the surface of the hard form member by the cleaning blade, the fountain solution removal system being configured to separate the fountain solution from the ink by subjecting the combination solution to a separation procedure while the combination solution is in the reservoir; and a heating system for heating the combination solution to evaporate fountain solution from the combination solution whereby the ink is substantially free of fountain solution.

14. The system of claim 13, comprising:

an ink supply system for supplying ink to the inking system, the ink comprising ink that is processed by the fountain solution removal system.

15. The apparatus of claim 6, wherein the heat source heats the combination solution to evaporate fountain solution from the combination solution whereby the ink is substantially free of fountain solution.

* * * * *